United States Patent [19]

Baker

[11] Patent Number: 4,536,699

[45] Date of Patent: Aug. 20, 1985

[54] FIELD EFFECT REGULATOR WITH STABLE FEEDBACK LOOP

[75] Inventor: Richard H. Baker, Bedford, Mass.

[73] Assignee: Gould, Inc., Rolling Meadows, Ill.

[21] Appl. No.: 571,033

[22] Filed: Jan. 16, 1984

[51] Int. Cl.[3] ..... G05F 1/58

[52] U.S. Cl. ..... 323/276; 323/280; 323/281; 361/18; 361/86

[58] Field of Search ..... 323/269, 273–276, 323/280, 281; 361/18, 57, 86, 90

[56] References Cited

U.S. PATENT DOCUMENTS

| | | | |
|---|---|---|---|
| 3,546,566 | 12/1970 | Marzolf | 323/273 |
| 4,005,353 | 1/1977 | Yokoyama | 323/281 |
| 4,382,224 | 5/1983 | Miller | 323/269 |
| 4,390,833 | 6/1983 | Tzeng | 323/281 |

OTHER PUBLICATIONS

Wu, "Designing Power Supplies with FETS", EEE, vol. 16, No 12, pp. 68, 69, Dec. 1968.

"MOS Power FET's Make Excellent Voltage Regulators", Electr. Eng. vol. 51, No. 618, p. 23, Feb. 1979.

Wyatt, "JFET Minimizes Regulator Differential, Extends Battery Life", Elect. Design, vol. 28, No. 24, pp. 302, 304, Nov. 22, 1980.

Heinzer, "Don't Trade Off Analog-Switch Specs.", Electr. Design 15, pp. 56–60, Jul. 19, 1977.

*Primary Examiner*—William H. Beha, Jr.

*Attorney, Agent, or Firm*—John R. Garrett; Edward E. Sachs

[57] ABSTRACT

A low voltage series pass regulator configuration has an input terminal for receiving a predetermined input voltage and an output terminal operatively connected to a load. The regulator comprises at least one field effect transistor in a source follower configuration. The drain of the field effect transistor is operatively connected to the input terminal and the source is operatively connected to the output terminal which provides an output voltage across the load. In one embodiment of the present invention a current limiter is operatively connected between the source and a gate of the field effect transistor. In another embodiment of the present invention a comparator for comparing the output voltage to a first reference voltage is provided. The comparator supplies a control voltage, indicative of the value of the output voltage compared to the first reference voltage, to the gate of the field effect transistor. This output voltage is indicative of the current drawn by the load and causes the comparator to produce a control voltage on the gate which keeps the output voltage substantially constant.

2 Claims, 8 Drawing Figures

FIELD EFFECT REGULATOR WITH STABLE FEEDBACK LOOP

BACKGROUND OF THE INVENTION

This invention relates generally to regulator circuits and more particularly concerns dc regulator circuits utilizing field effect transistors.

Regulator circuits are well known in the prior art and perform the function of providing an output voltage which remains substantially constant as different current levels are drawn from the regulator by a load connected to the output terminal. Also, the output voltage remains substantially constant for a predetermined range of input voltages to the regulator circuit. Typically, prior art regulator circuits use bipolar transistors, and which at low voltage operation are low frequency devices, and typically require at least 1.0 volts (minimum) to operate. This voltage drop results in a power dissipation in the form of heat. Generally these transistors are mounted on heat sinks in order to dissipate the heat built up in the transistor. This is especially true in applications in which high currents are required. The fact that the bipolar transistors require the dissipation of heat determines the physical size requirement of the regulator circuits.

Bipolar transistors have a negative temperature coefficient. Therefore as the bipolar transistor becomes hotter during operation, it will tend to decrease its internal resistance which can result in a runaway situation in which the transistor eventually burns up.

With the advent of field effect transistors, several important properties exist which when used with the present invention result in a significantly improved regulator circuit. One of the properties of importance is that FET's have a positive temperature coefficient, thereby excluding the possibility of a runaway, which in turn allow FET devices to be operated directly in parallel (without balast resistors) for increased output capacity. Also, FET's can be operated with significantly small voltage drop which in turn allows regulator design requiring less power dissipation than bipolar transistors. This also results in less energy loss in the novel regulator circuit of the present invention. Finally the FET has much higher frequency response (at low voltage) than do bipolar transistors which in turn allow designs that require less filtering.

SUMMARY OF THE INVENTION

The present invention involves a low loss voltage regulator which has an input terminal for receiving a predetermined input voltage and an output terminal operatively connected to a load. The regulator comprises at least one field effect transistor connected in a source follower configuration. The drain of the N type field effect transistor is operatively connected to a positive dc source of power and the source of the FET is operatively connected to the output terminal which provides an output voltage to the load. In one embodiment of the present invention a means for limiting current is operatively connected between the source and a gate of the field effect transistor. This produces a decrease in gate to source voltage as current drawn by the load increases, beyond a given limit. In another embodiment of the present invention a means for comparing the output voltage to a first reference voltage is provided. The means supplies a control voltage, indicative of the value of the output voltage compared to the first reference voltage, to the gate of the field effect transistor. This control voltage on the gate keeps the output voltage substantially constant and independent of the output current up to a preset limiting value.

OBJECTS OF THE INVENTION

It is a primary object of the present invention to provide an improved voltage regulator circuit which is low in loss.

It is another object of the present invention to provide a voltage regulator circuit utilizing self regulating field effect transistors.

It is a further object of the present invention to provide a voltage regulator which has a stable feedback loop.

It is yet another object of the present invention to provide a field effect transistor regulator which is economical to manufacture and reliable for relatively extreme ambient temperatures.

BRIEF DESCRIPTIONS OF THE DRAWINGS

The features of the present invention which are believed to be novel, are set forth with particularity in the appended claims. The invention, together with further objects and advantages, may best be understood by reference to the following description taken in conjunction with the accompanying drawings, in the several figures of which like reference numerals identify like elements, and in which;

DESCRIPTION OF THE PREFERRED EMBODIMENT

The novel low loss regulator circuit of the present invention utilizes field effect transistors and takes advantage of important properties of these devices. When used in a source follower configuration, the field effect transistor exhibits a very low drain to source voltage drop for significantly high currents. This results in low power dissipation required for these devices during operation which allows the circuit to be physically small in size and placed in a compact enclosure due to the small heat build-up. In addition the field effect transistor has a positive temperature coefficient thereby making it a self-regulating device and prevents the device from burning up with changes in temperature. Also, because FET devices exhibit a positive temperature coefficient, two or more field effect transistors in the source follower configuration may be directly placed in parallel to provide increased current output capability for the low loss regulator circuit.

In general terms the present invention is a low loss voltage regulator having an input terminal for receiving a predetermined input voltage range and an output terminal operatively connected to a load. The regulator comprises at least one field effect transistor in a source follower configuration. The drain on the field effect transistor is operatively connected to the variable voltage input terminal and the source is operatively connected to the output terminal, providing an output voltage across the load. In the FET switch embodiment of the invention a means for limiting current is operatively connected between the source and the gate of the field effect transistor. This limits maximum magnitude of the gate to source voltage as current drawn by the load increases.

In general, circuits having N-FETS are used for positive voltage regulation and circuits having P-FETS are used for negative voltage regulation. The circuits are mirror-images similar to the way circuits using PNP transistors are mirror images to circuits using NPN transistors.

In another the FET regulator embodiment of the present invention a means for comparing the output voltage to a first reference voltage is provided. The means for comparing supplies a control voltage indicative of the difference between the output voltage and the reference voltage to the gate of the field effect transistor. Therefore, when a change in current drawn by the load occurs, the means for comparing produces a control voltage on the gate which keeps the output voltage substantially constant.

Figure 1:
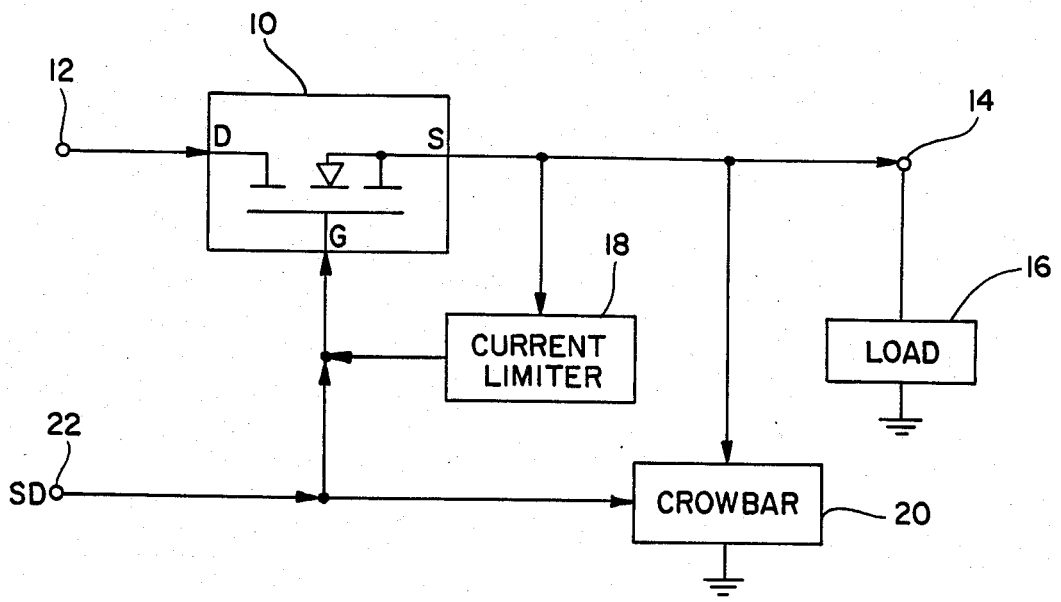
FIG. 1 is a block diagram of one embodiment of the novel low loss FET switch.

FIG. 1 depicts in block diagram form the FET current limiting switch embodiment of the present invention. A field effect transistor 10 has its drain connected to an input terminal 12 and its source connected to an output terminal 14. A load 16 is connected to the output terminal 14. A current limiter 18 is connected between the source and the gate of the field effect transistor 10. As an added feature, a crowbar circuit 20 is connected to the output terminal 14 and receives an input signal from shutdown terminal 22. The signal from the shutdown terminal 22 may also be connected to the gate of the field effect transistor 10. Circuitry (not shown) for detecting over or under voltages at the output terminal 14 may be utilized to produce the shutdown signal which is applied to terminal 22. When the signal is received at terminal 22, the crowbar circuit 18 causes the output terminal 14 to effectively be connected to ground thereby protecting the field effect transistor 10 and other circuitry in the low loss switch from high voltage spikes which may occur across the load for various reasons if the load is an active load. In addition, the signal occurring on shutdown terminal 22 may also be used to cause the gate terminal of the field effect transistor to effectively shut off the field effect transistor 10. As more current is drawn by the load 16 above some predetermined maximum causes, the current limiter 18 increases the gate to source voltage of 10 to remain constant thereby limiting the output current to remain substantially constant.

Figure 2:
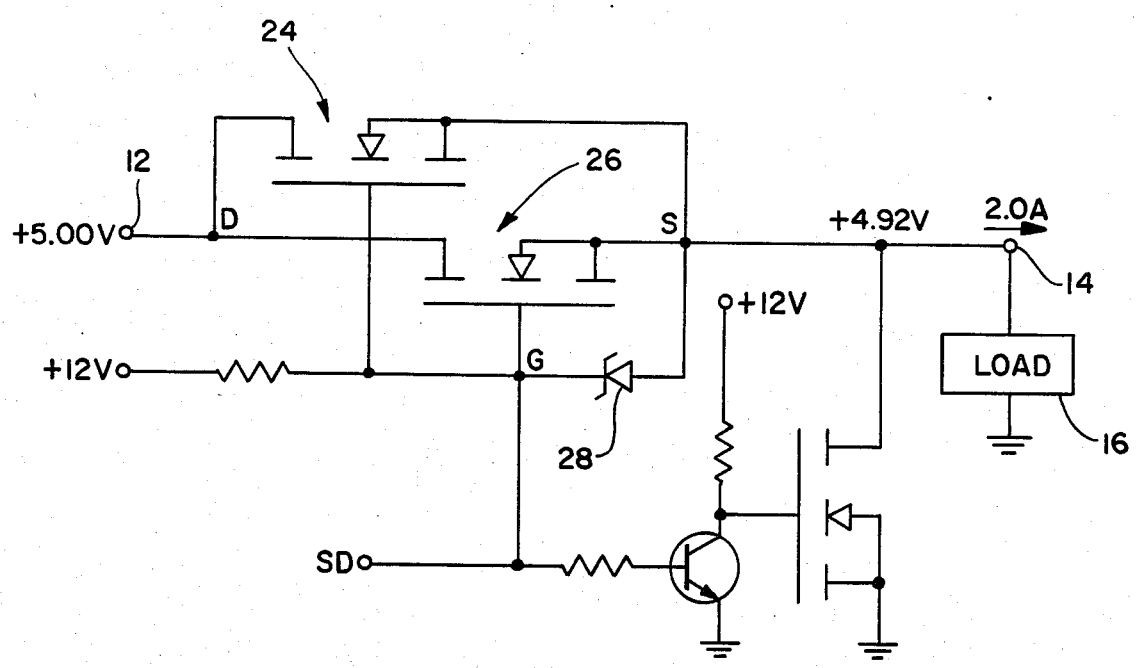
FIG. 2 is a circuit schematic of the FIG. 1 block diagram.
Figure 3:
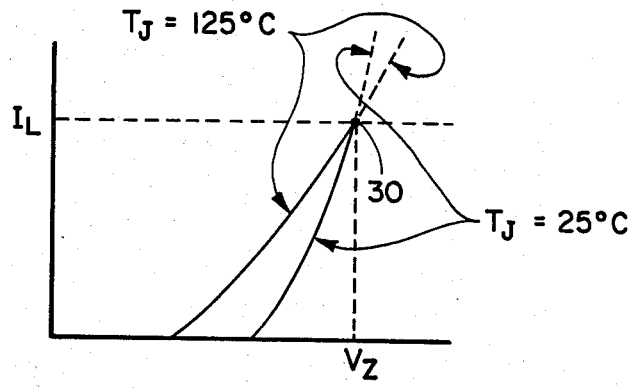
FIGS. 3 and 4 are graphs showing the operating parameters of the field effect transistors used in the FET switch.
Figure 4:
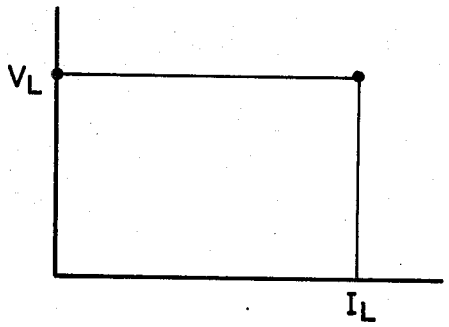

FIG. 2 is a schematic circuit of the FIG. 1 block diagram. In this embodiment two individual 50 milliohm N channel FET's 24 and 26 are connected directly in parallel in a source follower configuration. A Zener diode 28 is connected between the sources and gates of FET's 24 and 26. The Zener diode 28 functions as the current limiter 18 in FIG. 1. In the embodiment shown in FIG. 2 a positive five volts is applied to the input terminal 12. The load 16 connected to the output terminal 14 can draw a current up to 2.0 amps while the output voltage only varies between 5.00 volts at zero current, down to 4.92 volts at 2.00 amps. The maximum gate to source voltage is set by the Zener diode 28 to give current limiting. The FET type and Zener voltage can be selected to give a current limit $I_L$ at the temperature stable point of the FET transconductance as shown in FIG. 3. Point 30 in the FIG. 3 graph shows the transconductance level of the FET at which changes in temperature do not effect operation. $V_Z$ is the Zener diode breakdown voltage. This results in operation as shown in FIG. 4 where the voltage across the load, output voltage $V_L$, remains substantially constant for varying currents drawn by the load until the maximum current $I_L$ is reached at which point foldover occurs.

Figure 5:
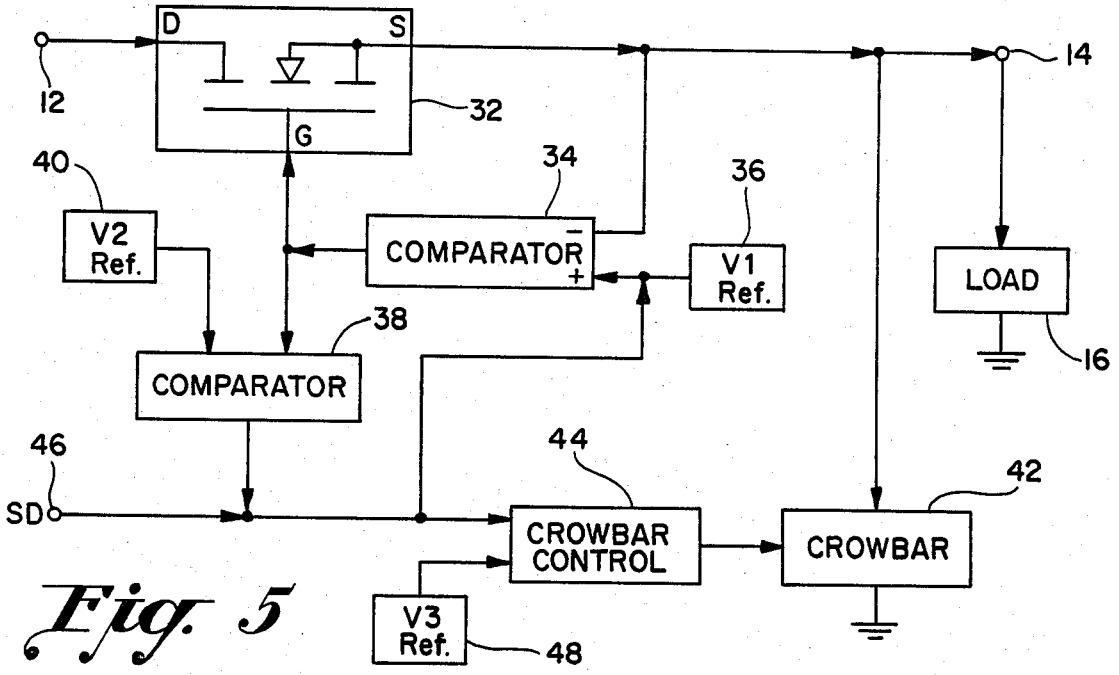
FIG. 5 is a block diagram of a low loss FET regulator.

FIG. 5 is a block diagram of the FET regulator embodiment of the present invention. In this embodiment a field effect transistor 32 has its drain connected to an input terminal 12 and its source connected to an output terminal 14. An active or passive load 16 is connected to the output terminal 14. A comparator 34 compares the output voltage at the output terminal 14 to a first reference voltage 36. The comparator 34 has its negative input operatively connected to the source of the field effect transistor 32 and its positive input operatively connected to the first reference voltage 36. The comparator 34 outputs a control voltage which is received by the gate of the field effect transistor 32 and is indicative of the difference between the output voltage at terminal 34 and the first reference voltage 36. As the load 16 draws more current, the output voltage at output terminal 14 begins to decrease. When this happens, the control voltage supplied by the comparator 34 causes an increase in the source to gate voltage of the FET 32 thereby increasing and restoring the output voltage of the regulator. This feed back circuit effectively keeps the output voltage substantially constant.

When the load 16 attempts to draw current from the regulator which is above a predetermined maximum level, a second comparator means 38, compares the output control voltage from the comparator 34 to a second reference voltage 40, which outputs a voltage which modifies the first reference voltage 36 causing the comparator 34 to change the control voltage in a manner which decreases the gate to source voltage of the field effect transistor 32 thereby limiting the amount of current which can be drawn by the load 16 to the predetermined maximum value.

The FIG. 5 embodiment also includes a crowbar circuit 42 with a crowbar control circuit 44 which compares the signal received on the shutdown terminal 46 with a third reference voltage 48 to determine when the output terminal 14 should be effectively connected to ground for protection of the regulator.

Figure 6:
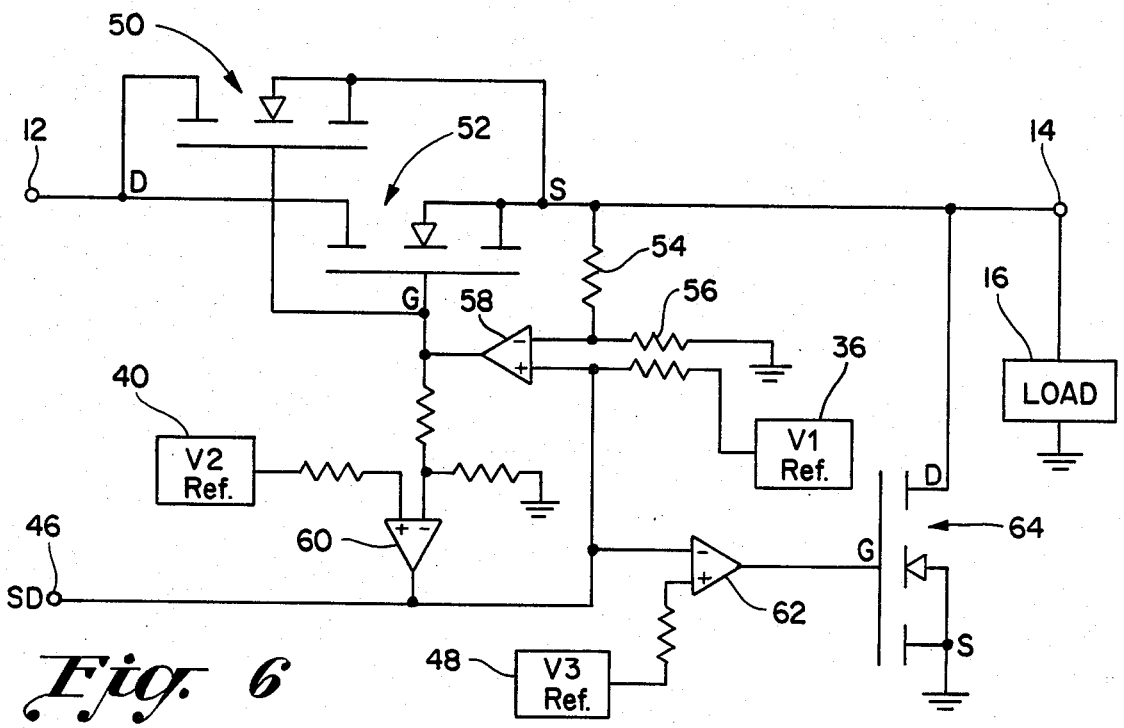
FIG. 6 is a schematic diagram of the FIG. 5 block diagram.

FIG. 6 is a schematic diagram of an embodiment of the FIG. 5 block diagram. The FIG. 6 circuit shows the use of two field effect transistors 50 and 52 connected in parallel in a source follower configuration to increase the current output capability of the novel regulator. In this embodiment resisters 54 and 56 have equal values and form a voltage divider circuit. Comparator 58 is a high gain amplifier and comparator, type LM324, which has its negative input connected to the juncture of resistors 54 and 56 and its positive input operatively connected to the first reference voltage 36 which is set at a value equal to one-half of the desired output voltage. The output of the amplifier 58 is connected to the gate of FET 50 and 52. The output of the amplifier 58 is also connected to the negative input of a comparator 60, the positive input of comparator 60 being connected to a second reference voltage 40.

The output of comparator 60 is connected to the negative input of a comparator 62 which is used to control the crowbar 64, which in this embodiment is an FET 64 in an amplifier configuration with its drain connected to the output terminal 14, its source grounded and its gate connected to the output of comparator 62. A third reference voltage 48 is connected to the positive input of the comparator 62, such that when the negative input of comparator 62 becomes less than the positive input, a signal is output by comparator 62 which causes FET 64 to conduct and effectively ground the output terminal 14.

Figure 7:
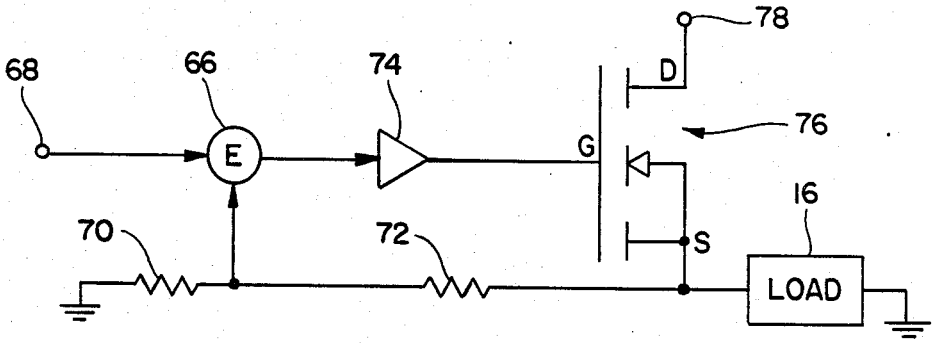
FIG. 7 is a schematic representation of the stable feedback loop used in the FIG. 6 circuit.
Figure 8:
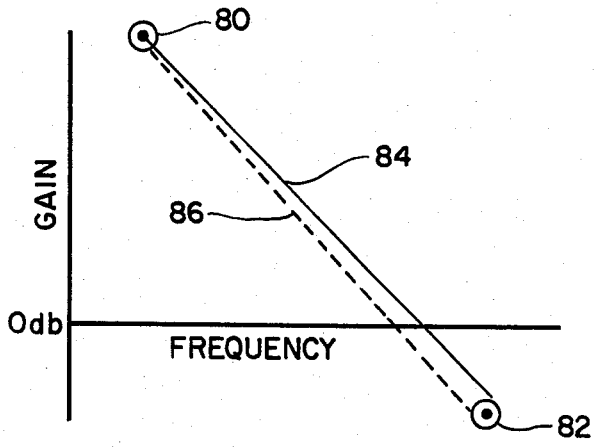
FIG. 8 is a graph depicting the pole locations of components in the FIG. 7 feedback loop.

The basic feedback loop of the regulator is schematically shown in FIG. 7. A summing junction 66 creates an error signal from a reference voltage on terminal 68 and the input from the resistor divider network comprised of resisters 70 and 72. The high gain amplifier 74 is the LM324 chip. The amplifier receives its input from the summing junction 66 and outputs the amplified signal to the gate of FET 76. FET 76 has its drain connected to input terminal 78 and its source connected to the load 16. The FET 76 is in a source follower configuration. In the source follower configuration the FET 76 has a voltage gain which is less than unity, yet has a very high frequency response even at low drain to source voltages. The LM324 high gain amplifier is a very stable device and has a low frequency dominant pole 80 as shown in the FIG. 8 graph. The FET 76 has a dominant pole 82 at a high frequency which occurs below the 0 DB level as shown in the FIG. 8 graph. The solid line 84 in the graph is the gain of the amplifier 74 and the dotted line 86 in the graph illustrates the loop gain of the system. As shown by the graph, the system is unconditionally stable due to the combination of the low frequency dominant pole 80 of the amplifier and the second high frequency pole 82 of the FET being below zero db. This novel combination is not naturally achieved with a bipolar transistor which does not have the high frequency response. As a result, in order to obtain gooid transient response high frequency amplifiers must be used with bipolar transistors and the system is difficult to stabilize.

The novel regulator as disclosed in FIG. 5 provides an isolated positive 4.3 volt output from a 5.00 volt source with a current limit at approximately 11 amps. To achieve this, two low voltage 50 milliohm FET's were connected in parallel and the LM324 chip was used as the high gain amplifier comparator. The output regulation of the circuit was approximately 1 millivolt per amp. The values for the first and second reference voltages can be set to limit the current at the output to about 11.5 amps. In addition the third reference voltage can be set such that a negative going output from comparator 60 causes comparator 62 to turn on FET 64 and crowbar the output terminal 14 at a level just above the current limit of 11.5 amps.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A low loss regulator having an input terminal for receiving a predetermined input voltage and an output terminal operatively connected to a load, said regulator comprising:

at least one field effect transistor in a source follower configuration having its drain operatively connected to the input terminal, its source operatively connected to the output terminal, providing an output voltage across the load, and a gate;

means for comparing said output voltage to a first reference voltage and supplying a control voltage indiciative thereof to said gate, such that a change in current drawn by the load causes said means for comparing to produce a control voltage on said gate which keeps said output voltage substantially constant, said means for comparing comprises amplifier means for providing a high gain having a negative input operatively connected to the output terminal and a positive input operatively connected to said first reference voltage and an output operatively connected to said gate; and means for clamping the output current drawn by the load to a predetermined value, said means for clamping operatively connected between said output of said high gain amplifier means and said positive input of said high gain amplifier means such that when said control voltage reaches a predetermined level said means for clamping outputs a voltage which modifies said first reference voltage and thereby prevents the load from drawing current more than said predetermined value.

2. The regulator described in claim 1 wherein said means for clamping comprises a comparator having a negative input operatively connected to said output of said high gain amplifier means, a positive input operatively connected to a second reference voltage, and an output operatively connected to said positive input of said high gain amplifier means such that when the level of said control voltage exceeds said second reference voltage an output voltage from said comparator effectively changes said first reference voltage to clamp said current drawn by the load to said predetermined value.

* * * * *